United States Patent [19]

Yamada et al.

[11] 4,334,333

[45] Jun. 15, 1982

[54] METHOD OF DYEING TREATMENT FOR A FABRIC AND APPARATUS THEREFOR

[75] Inventors: Kazuo Yamada, Oharu; Hiroshi Yamashita, Nagoya; Hiroshi Mizutani, Mie; Mitsuru Sugimura, Tsushima, all of Japan

[73] Assignee: Nihon Senshoku Kikai Kabushiki Kaisha, Aichi, Japan

[21] Appl. No.: 159,208

[22] Filed: Jun. 13, 1980

Related U.S. Application Data

[63] Continuation of Ser. No. 7,761, Jan. 29, 1979, abandoned.

[30] Foreign Application Priority Data

Feb. 10, 1978 [JP] Japan ..... 53-13601

[51] Int. Cl.[3] ..... D06B 3/10; D06B 17/02

[52] U.S. Cl. ..... 8/152; 68/153; 68/177

[58] Field of Search ..... 8/151, 152; 68/53, 62, 68/148, 170, 152–158, 175, 177, 178, 179, 184

[56] References Cited

U.S. PATENT DOCUMENTS

| | | | |
|---|---|---|---|
| 2,826,057 | 3/1958 | Olson | 68/53 X |
| 3,359,763 | 12/1967 | Koshino | 68/155 |
| 3,690,128 | 9/1972 | Biesinger | 68/158 X |
| 3,718,012 | 2/1973 | Vinas | 68/177 X |
| 3,821,883 | 7/1974 | Horie et al. | 68/153 X |
| 3,949,579 | 4/1976 | Bertoldi | 68/152 |

*Primary Examiner*—Philip R. Coe

*Attorney, Agent, or Firm*—Wenderoth, Lind & Ponack

[57] ABSTRACT

A method of dyeing a fabric connected in an endless form while repeatedly circulating said fabric through a dyeing tank is improved by providing a residence vessel made of a perforated plate within said dyeing tank and either rocking or vertically reciprocating said residence vessel as immersed in a dyeing liquor while said fabric is being stagnated within said residence vessel. Owing to the rocking or vertical reciprocating motion of the residence vessel, the dyeing liquor is made to flow into and out of said residence vessel, penetrating therethrough, and thereby the necessary amount of the dyeing liquor can be reduced and the dyeing time can be shortened. A desirable apparatus for practicing said improved method is also provided.

2 Claims, 2 Drawing Figures

METHOD OF DYEING TREATMENT FOR A FABRIC AND APPARATUS THEREFOR

Figure 1:
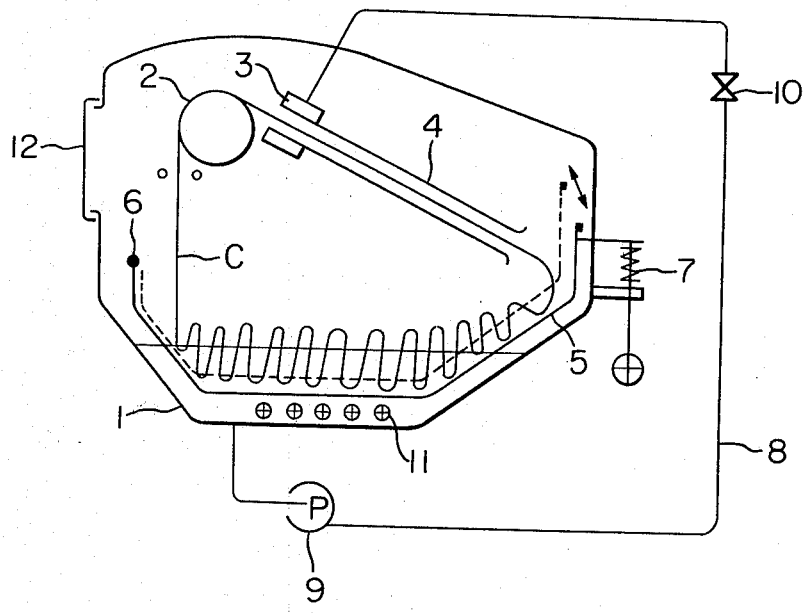

This is a continuation of application Ser. No. 7,761, filed Jan. 29, 1979, now abandoned.

The present invention relates to a method and an apparatus for dyeing treatment of the type in which a fabric connected in an endless form is repeatedly circulated through a dyeing tank charged with a dyeing liquor.

Heretofore, in the case where a fabric connected in an endless form is subjected to a treatment such as dyeing, scouring, bleaching, etc. while it is being repeatedly circulated through a dyeing tank, a dyeing apparatus of the above-described type necessitated an amount of a treatment liquor that is about 20 to 30 times as heavy as the weight of the fabric to be treated.

Therefore, it is one object of the present invention to save and reduce the amount of the treatment liquor to be used in such a treatment to about 3 to 5 times as heavy as the fabric to be treated and thereby achieve saving of resources, saving of energy and rationalization of operations.

According to one feature of the present invention, there is provided a method of dyeing treatment for a fabric, characterized in that a residence vessel made of a perforated plate and equipped within a dyeing tank, in which a fabric to be treated that is connected in an endless form is accommodated so as to be repeatedly circulated therethrough, is rocked or vertically reciprocated to forcibly forward said fabric within said residence vessel and also to make a dye liquor flow into and out of said residence vessel, penetrating therethrough, whereby the necessary amount of the dye liquor can be reduced and also the dyeing time for the fabric to be treated can be shortened.

Since the present invention has the aforementioned feature, in the method according to the present invention the residence vessel repeats its rocking or vertical reciprocating motion within the dyeing tank either continuously or intermittently while the fabric to be treated, that is connected in an endless form and is adapted to be repeatedly circulated through the dyeing tank, is being forwarded through the residence vessel, so that the dye liquor within the dyeing tank can be stirred thereby almost eliminating any temperature difference of the dye liquor in an effective dyeing section in the dyeing tank. Furthermore, since said residence vessel is made of a perforated plate as described above, each time the residence vessel undergoes a rocking or vertical reciprocating motion, the dye liquor flows into and out of the residence vessel within the dyeing tank, penetrating through the perforations of the residence vessel, so that the dye liquor contacting the fabric to be treated can be replaced frequently, and thereby uneven dyeing can be prevented. Since a residence vessel in the prior art was not constructed so as to be rocked or vertically reciprocated freely, replacement of the dye liquor contacting the fabric to be treated in the residence vessel would scarcely occur, resulting in a large temperature difference of the dye liquor within the dyeing tank, and therefore, in order to prevent uneven dyeing, the dyeing time had to be unnecessarily prolonged. Whereas, according to the present invention, such a waste of time can be greatly eliminated.

In addition, owing to the movement of the residence vessel in the above-described manner, the fabric to be treated is subjected to an appropriate crumpling effect while moving continuously, even if the amount of the dye liquor is small, and it is forcibly forwarded and again drawn up by means of a circulating device, and when it is drawn up in the above-described manner, the positions of the creases can be changed to prevent fixing of the creased positions.

As described above, according to the present invention, by effecting movement of a residence vessel made of a perforated plate, without using special chemicals it is possible to greatly reduce the necessary amount of the dye liquor and also to effectively carry out dyeing treatment, and therefore, the invention is useful for saving of resources, saving of energy and rationalization of operations.

According to another feature of the present invention, there is provided a dyeing apparatus for a fabric, characterized in that said apparatus comprises a dyeing tank in which a fabric to be treated, that is connected in an endless form, is accommodated so as to be repeatedly circulated therethrough, a residence vessel made of a perforated plate and pivotably supported within said dyeing tank so as to be rocked or vertically reciprocated freely, and means associated with said dyeing tank for driving said residence vessel.

This apparatus is useful for smoothly practicing the method according to the present invention.

Figure 2:
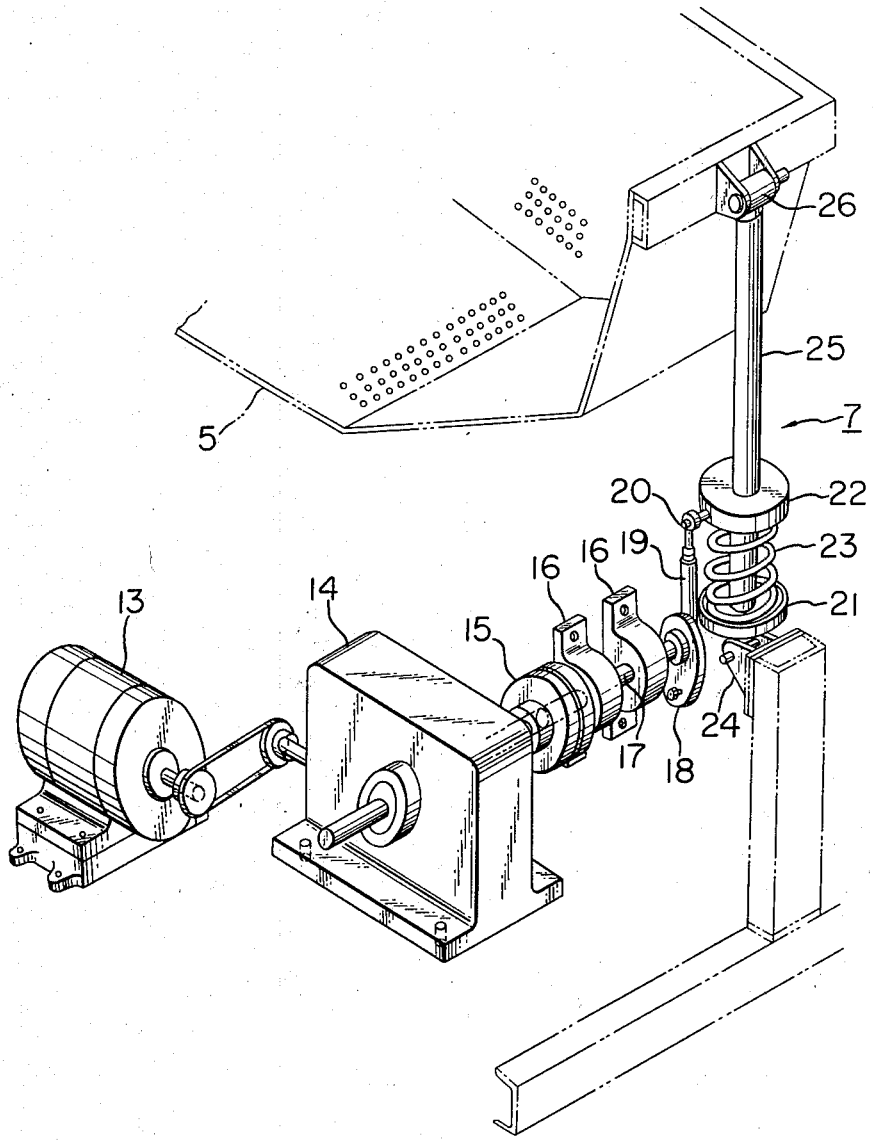

The above-mentioned and other features and advantages of the present invention will become more apparent by reference to the following description of a preferred embodiment of the invention taken in conjunction with the accompanying drawings, in which:

FIG. 1 is a schematic longitudinal cross-section view showing one preferred embodiment of a dyeing treatment apparatus that is available for practicing the method of dyeing treatment for a fabric according to the present invention, and FIG. 2 is a perspective view showing details of a driving device for a residence vessel.

Referring now to FIG. 1 of the drawings, reference numeral (1) designates a dyeing tank in which, at its front upper portion, is disposed a main reel (2) for drawing up a fabric (C) to be treated that is connected in an endless form. Adjacent to the main reel (2), on its rear side, and inclined conduit (4) provided with a dye liquor shower section (3) at its inlet end is extended in the obliquely downward direction. At the bottom of the dyeing tank (1) is disposed a residence vessel (5) made of a perforated plate, and the front top end of the residence vessel (5) is pivotably supported about an axis (6) from the dyeing tank (1) so as to be freely rocked. Reference numeral (7) designates a driving device for the residence vessel (5), which is adapted to rock the residence vessel (5) about the pivotal axis (6) by intermittently pushing up the rear end of the residence vessel (5) with a well-known mechanism.

In FIG. 1, reference numeral (8) designates a dye liquor circulating conduit which communicates between the bottom of the dyeing tank (1) and the dye liquor shower section (3), and reference numerals (9) and (10) designate a pump and a flow rate regulating valve, respectively, interposed in the conduit (8).

In addition, reference numeral (11) in the same figure designates a heat exchanger disposed within the dyeing tank (1), which can be, in some cases, disposed outside of the dyeing tank (1), and reference numeral (12) designates an operation window.

Since the illustrated embodiment is constructed as described above, the fabric (C) to be treated is at first drawn up by the main reel (2), then it is impregnated with a dye liquor jetted from the dye liquor shower section (3) into the interior of the woven structure of the fabric (C), and the fabric (C) is passed through the inclined conduit (4) to be fed into the residence vessel (5).

Then the residence vessel (5) repeats vertical reciprocating or rocking motions either continuously or intermittently by means of the driving device (7) as shown by a dotted line. Owing to this rocking or vertical reciprocating motion of the residence vessel (5), the dye liquor within the dyeing tank (1) can be stirred, thereby almost eliminating any temperature difference of the dye liquor in the effective dyeing region. In addition, since the residence vessel (5) is made of a perforated plate, each time the residence vessel (5) is moved up and down, the dye liquor flows into and out of the residence vessel (5), so that the dye liquor contacting the fabric (C) to be treated can be replaced frequently, and thereby uneven dyeing can be prevented.

Furthermore, owing to the movement of the residence vessel (5), even if the amount of the dye liquor is small, the fabric (C) to be treated undergoes an appropriate crumpling effect while it is continuously moved, and thus it is forcibly forwarded and then again drawn up by the main reel (2). During this drawing-up period, the positions of the creases are changed and thereby fixing of the creases can be prevented.

FIG. 2 shows details of the driving device (7) for the residence vessel (5), in which reference numeral (13) designates an electric motor which rotates a reduction gear (14), and the low speed rotation is transmitted via a coupling (15) to a rotary arm (18) mounted on a shaft (17). Reference numeral (16) designates bearings. The rotation of the rotary arm (18) is converted into a linear motion via a tie rod (19), and thereby a vertical reciprocating motion is given to a joint (20), a spring receiver (22) and a strut (25). At the top of the strut (25) is provided a joint (26) for connection with the residence vessel (5) and thereby the vertical movement of the strut (25) can be surely transmitted to the residence vessel (5).

Reference numeral (23) designates a spring which serves to smoothly effect the motion of the residence vessel (5). A spring receiver (21) and a bracket (24) are mounted on a frame of the dyeing tank (1) to support the moving residence vessel (5).

It is to be noted that in the illustrated embodiment the residence vessel (5) is supported by vertical driving sections at two separate positions.

While the present invention has been described above in connection with its preferred embodiment, of course the invention should not be limited to only such an embodiment, and various changes in design could be made without departing from the spirit of the present invention.

What is claimed is:

1. A method of dyeing a fabric, which comprises providing a residence vessel having a perforated bottom plate, perforated side plates and an open top, said residence vessel being positioned within a dyeing tank equipped with dye liquor, positioning an endless form of said fabric in said dyeing tank so as to be repeatedly circulated through said dyeing tank and said residence vessel, applying said dye liquor to said fabric at an upper portion of said dyeing tank, reciprocating said residence vessel as a whole substantially in a vertical direction, to forcibly forward said fabric within said residence vessel and also to cause dye liquor in a bottom portion of said dyeing tank to flow into and out of perforations in said residence vessel, in a manner such that, in the length of said fabric between the initial point of entry of said fabric into said dye liquor in said residence vessel and the final point of exit of said fabric from said dye liquor in said residence vessel, there are portions of said length of fabric which are above the level of said dye liquor in said residence vessel, and recirculating said dye liquor from said bottom portion of said dyeing tank to said upper portion of said dyeing tank.

2. A dyeing apparatus for dyeing a fabric, said apparatus comprising a dyeing tank for accommodating a fabric to be dyed, a residence vessel having a perforated bottom plate, perforated side plates and an open top, said residence vessel being pivotably supported at one end thereof within said dyeing tank so as to be freely reciprocated as a whole substantially in a vertical direction to forcibly forward the fabric within said residence vessel, means associated with said dyeing tank for driving said residence vessel substantially in a vertical direction about the pivotably supported one end thereof, means for repeatedly circulating the fabric in endless form through said dyeing tak and said residence vessel, means for applying a dye liquor to the fabric and positioned in an upper portion of said dyeing tank, and means for recirculating the dye liquor from a bottom portion of said dyeing tank to said means for applying the dye liquor to the fabric.

* * * * *